US008020406B2

(12) United States Patent
Vandor et al.

(10) Patent No.: US 8,020,406 B2
(45) Date of Patent: Sep. 20, 2011

(54) METHOD AND SYSTEM FOR THE SMALL-SCALE PRODUCTION OF LIQUIFIED NATURAL GAS (LNG) FROM LOW-PRESSURE GAS

(76) Inventors: David Vandor, Tarrytown, NY (US); Ralph Greenberg, Santa Rosa, CA (US)

( * ) Notice: Subject to any disclaimer, the term of this patent is extended or adjusted under 35 U.S.C. 154(b) by 826 days.

(21) Appl. No.: 11/934,845

(22) Filed: Nov. 5, 2007

(65) Prior Publication Data

US 2009/0113928 A1 May 7, 2009

(51) Int. Cl.
*F25J 1/00* (2006.01)

(52) U.S. Cl. ..... 62/613; 62/619

(58) Field of Classification Search ..... 62/612, 62/613, 611, 617, 618, 619
See application file for complete search history.

(56) References Cited

U.S. PATENT DOCUMENTS

| | | | | |
|---|---|---|---|---|
| 2,207,838 | A * | 7/1940 | Thomas | 62/101 |
| 3,015,940 | A | 1/1962 | Harwich | |
| 3,483,710 | A | 12/1969 | Bearint | |
| 3,724,224 | A | 4/1973 | Matthews | |
| 3,817,046 | A | 6/1974 | Aoki et al. | |
| 3,818,714 | A | 6/1974 | Etzbach et al. | |
| 4,065,278 | A | 12/1977 | Newton | |
| 4,456,459 | A | 6/1984 | Brundige, Jr. | |
| 4,541,852 | A | 9/1985 | Newton | |
| 4,586,344 | A | 5/1986 | Lutz | |
| 4,695,303 | A | 9/1987 | Montgomery, IV | |
| 4,702,819 | A | 10/1987 | Sharma | |
| 4,745,768 | A | 5/1988 | Schorr et al. | |
| 4,873,839 | A | 10/1989 | Dessanti | |
| 4,907,405 | A * | 3/1990 | Polizzotto | 60/772 |
| 4,936,109 | A | 6/1990 | Longardner | |
| 5,107,906 | A * | 4/1992 | Swenson et al. | 141/11 |
| 5,363,655 | A | 11/1994 | Kikkawa | |
| 5,505,232 | A | 4/1996 | Barclay | |
| 5,600,969 | A | 2/1997 | Low | |
| 5,615,561 | A | 4/1997 | Houshmand | |
| 5,768,912 | A | 6/1998 | Dubar | |
| 5,956,971 | A | 9/1999 | Cole | |
| 6,023,942 | A | 2/2000 | Thomas | |
| 6,050,083 | A * | 4/2000 | Meckler | 60/39.182 |

(Continued)

FOREIGN PATENT DOCUMENTS

AU 739054 10/2001

(Continued)

*Primary Examiner* — Cheryl J Tyler
*Assistant Examiner* — John Pettitt
(74) *Attorney, Agent, or Firm* — Michael A. Blake

(57) ABSTRACT

A method and system for the small-scale production of LNG. The method comprising: configuring a prime mover to be operable communication with a multi-stage compressor; configuring the prime mover to be in fluid communication with an ammonia absorption chiller; configuring the ammonia absorption chiller to be in fluid communication with the multi-stage compressor; operating the ammonia absorption chiller using waste heat from a prime mover; pre-cooling a first stream of natural gas using cooled fluid from the ammonia absorption chiller; cooling a first portion of the first stream of natural gas, using an expansion valve, into a two-phase stream; cooling a second portion of the first stream to liquefied natural gas, using the two-phase stream as a cooling fluid; delivering the second portion of the first stream as LNG to a low-pressure LNG tank; cooling a third portion of the first stream of natural gas in a turbo-expander; separating liquid heavies out of the third portion of the first stream of natural gas; and delivering the liquid heavies to a pressure tank.

11 Claims, 3 Drawing Sheets

U.S. PATENT DOCUMENTS

| | | | | |
|---|---|---|---|---|
| 6,085,545 | A * | 7/2000 | Johnston | 62/613 |
| 6,085,546 | A * | 7/2000 | Johnston | 62/613 |
| 6,085,547 | A * | 7/2000 | Johnston | 62/613 |
| 6,158,240 | A | 12/2000 | Low | |
| 6,158,241 | A | 12/2000 | Erickson | |
| 6,220,052 | B1 | 4/2001 | Tate, Jr. | |
| 6,269,656 | B1 | 8/2001 | Johnston | |
| 6,321,552 | B1 | 11/2001 | Frederiksen | |
| 6,425,263 | B1 | 7/2002 | Bingham | |
| 6,446,465 | B1 | 9/2002 | Dubar | |
| 6,449,982 | B1 | 9/2002 | Fischer | |
| 6,640,586 | B1 * | 11/2003 | Baudat et al. | 62/612 |
| 6,658,890 | B1 * | 12/2003 | Hahn et al. | 62/611 |
| 6,751,985 | B2 * | 6/2004 | Kimble et al. | 62/613 |
| 7,210,311 | B2 | 5/2007 | Wilkinson | |
| 7,219,512 | B1 | 5/2007 | Wilding | |
| 7,225,636 | B2 | 6/2007 | Baudat | |
| 2003/0000698 | A1 | 1/2003 | Lecomte | |
| 2003/0019240 | A1 | 1/2003 | Neeraas | |
| 2003/0037567 | A1 | 2/2003 | Lu | |
| 2003/0121268 | A1 | 7/2003 | Errickson | |
| 2003/0136146 | A1 | 7/2003 | Fischer-Calderon et al. | |
| 2003/0196452 | A1 | 10/2003 | Wilding | |
| 2004/0003625 | A1 | 1/2004 | Fischer | |
| 2005/0005635 | A1 | 1/2005 | LeMetais | |
| 2005/0279132 | A1 * | 12/2005 | Eaton et al. | 62/613 |
| 2006/0112725 | A1 | 6/2006 | Owen | |
| 2006/0137391 | A1 | 6/2006 | Baudat | |
| 2006/0213222 | A1 | 9/2006 | Whitesell | |
| 2006/0213223 | A1 | 9/2006 | Wilding | |
| 2007/0107465 | A1 | 5/2007 | Turner | |
| 2007/0113584 | A1 * | 5/2007 | Eaton et al. | 62/613 |

FOREIGN PATENT DOCUMENTS

| | | |
|---|---|---|
| EP | 102087 | 3/1984 |
| EP | 0360229 | 3/1990 |
| EP | 0414107 | 2/1991 |
| EP | 1092931 | 4/2001 |
| GB | 1181049 | 2/1970 |
| GB | 1541087 | 2/1979 |
| GB | 1596330 | 8/1981 |
| GB | 2357140 | 6/2001 |
| NL | 1020810 C | 12/2002 |
| RU | 2180081 | 2/2002 |
| WO | WO 9527179 | 10/1995 |
| WO | WO 0025075 | 5/2000 |
| WO | WO 01/46634 | 6/2001 |
| WO | WO 0144735 | 6/2001 |
| WO | WO 01/49394 | 7/2001 |
| WO | WO 01/88447 | 11/2001 |
| WO | WO 02/079706 | 10/2002 |
| WO | WO 02/086404 | 10/2002 |
| WO | WO 2004/065869 | 8/2004 |
| WO | WO 2006009610 | 1/2006 |
| WO | WO 2006049885 | 5/2006 |
| WO | WO 2007021351 | 2/2007 |

* cited by examiner

METHOD AND SYSTEM FOR THE SMALL-SCALE PRODUCTION OF LIQUIFIED NATURAL GAS (LNG) FROM LOW-PRESSURE GAS

TECHNICAL FIELD

The present invention relates generally to the compression and liquefaction of gases, and more particularly to the liquefaction of a gas, such as natural gas, on a small scale.

BACKGROUND

There are no commercially viable Small-Scale liquefied natural gas (LNG) production facilities anywhere in the world. "Small-Scale" means less than 10,000 liters/day. Thus, any existing liquefied natural gas-fueled fleet must depend on deliveries by tanker truck from larger-scale LNG plants or from LNG import terminals. The use of tanker trucks or terminals increases the cost of the LNG to the end user, because the delivered price must include the substantial cost of transporting the LNG from the production or import location to the customer. Those transportation costs tend to outweigh the lower production costs of large-scale LNG manufacture, where there is a large distance between the LNG source and the customer.

The LNG customer must also maintain a large storage tank so that deliveries can be spread out in time. Such tanks produce "boil off" which is generally vented to the atmosphere, causing methane emissions and loss of product, further increasing the net cost of the LNG, to both the end user and (by way of the emissions) to society at large. Heat gain to the storage tank, in the absence of on-site liquefaction, results in LNG that is not the ideal density for the vehicle's fuel tank. Re-liquefaction to avoid boil-off or to increase the product's density is not an option without an on-site LNG plant.

Other drawbacks to tanker-delivered LNG include the lack of competition in the industry, making the fleet owner excessively dependent on a single supplier. The quality of the delivered product may also vary, to the detriment of the fleet that uses the fuel.

The alternative that is commonly used is on-site Compressed Natural Gas (CNG) production, using the local natural gas pipeline as the feed source. However, such CNG systems have severe limitations, including the following: CNG, because it is not very dense, cannot be stored in large quantities, so it must be made at a high capacity during the peak vehicle fueling demand period. Similarly, the on-vehicle storage of CNG is limited by the need for heavy, high-pressure CNG tanks that store relatively little product, compared to the much denser LNG, and thus limit the travel range of the CNG vehicle.

Therefore, a system for the small-scale production of LNG from low-pressure pipelines and stranded wells is needed to overcome the above listed and other disadvantages of existing methods of converting low-pressure natural gas to a dense form that is easily storable and transportable.

SUMMARY

The disclosed invention relates to a method for the small scale production of LNG comprising: configuring a prime mover to be operable communication with a multi-stage compressor; configuring the prime mover to be in fluid communication with an ammonia absorption chiller; configuring the ammonia absorption chiller to be in fluid communication with the multi-stage compressor; operating the ammonia absorption chiller using waste heat from a prime mover; precooling a first stream of natural gas using cooled fluid from the ammonia absorption chiller; cooling a first portion of the first stream of natural gas, using an expansion valve, into a two-phase stream; cooling a second portion of the first stream to liquefied natural gas, using the two-phase stream as a cooling fluid; delivering the second portion of the first stream to a pressure tank; cooling a third portion of the first stream of natural gas in a turbo-expander; separating liquid heavies out of the third portion of the first stream of natural gas; and delivering the liquid heavies to a pressure tank.

The discloses invention also relates to a system for the small scale production of LNG comprising: a natural gas supply; a prime mover in fluid communication with the natural gas supply, and in fluid communication with a third heat exchanger; a multi-stage compressor in operational communication with the prime mover; the multi-stage compressor comprising a first stage compressor, a second stage compressor, and a third stage compressor; a first inter-cooler in fluid communication with the first stage compressor; a molecular sieve in fluid communication with the first inter-cooler and in fluid communication with the natural gas supply; a fourth heat exchanger in fluid communication with the molecular sieve and in fluid communication with the first stage compressor; a second inter-cooler in fluid communication with the second stage compressor; a first heat exchanger in fluid communication with the second inter-cooler and in fluid communication with the third stage compressor; an after-cooler in fluid communication with the third stage compressor; a second heat exchanger in fluid communication with the after-cooler; a main heat exchanger in fluid communication with the second heat exchanger, in fluid communication with a phase separator, in fluid communication with a turbo-expander, and in fluid communication with the fourth heat exchanger; a first expansion valve in fluid communication with the main heat exchanger; a sub-cooling heat exchanger in fluid communication with the first expansion valve; a second expansion valve in fluid communication with the sub-cooling heat exchanger; a pressure tank in fluid communication with the second expansion valve; a four-way valve in fluid communication with the pressure tank; the four-way valve in fluid communication with the sub-cooling heat exchanger and in fluid communication with the main heat exchanger; the turbo-expander in fluid communication with the phase separator, and in operational communication with an expander driven compressor; the expander driven compressor in fluid communication with a fifth heat exchanger; the fifth heat exchanger in fluid communication with second stage compressor; an ammonia absorption chiller in fluid communication with the prime mover, in fluid communication with the first heat exchanger, in fluid communication with the second heat exchanger, in fluid communication with the third heat exchanger, and in fluid communication with a cooling tower; and a make-up water line in fluid communication with the cooling tower.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
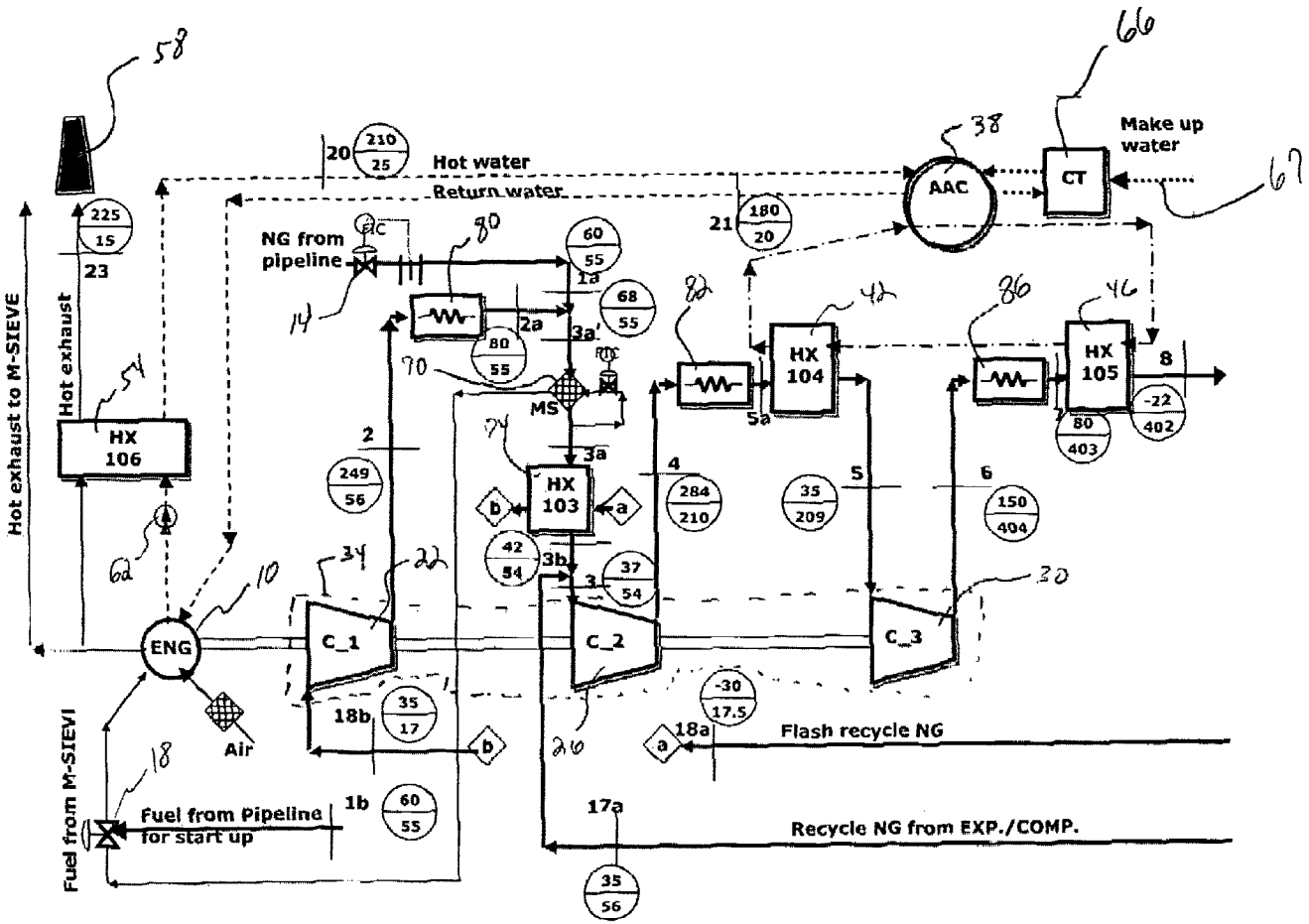
FIG. 1 is a portion of a process diagram of the system.

The inventors, who are experts in this field, are not aware of any existing, commercially viable Small-Scale LNG plants anywhere in the world. The smallest LNG plant that they are aware of, in the state of Delaware in the US, produces approximately 25,000 gallons (95,000 liters) per day. By contrast, the proposed invention will be viable at a production rate of only 6,000 liters per day. That "small-scale" is an essential component of the business model for the invention, namely that it will provide vehicle grade LNG to a medium-sized bus or truck fleet, without requiring that a portion of the plant's output be shipped to a second and third, off-site fleet. In short, each small-scale LNG plant can act as an "appliance" that serves a single customer at a single location. Such small-scale LNG plants will also allow stranded gas fields (those not near pipelines, or too small for pipeline extensions) to be developed, allowing the produced LNG to be sent to off-site customers or to distant pipelines for re-gasification.

The ability to economically produce vehicle-grade LNG will be achieved by two aspects of the invention: a) low capital costs, and b) high-efficiency.

The invention will allow a 2,000-gallon/day LNG plant to be constructed for less than $1,000,000. The innovative LNG production cycle will yield approximately 83% LNG out of every unit of natural gas that is delivered to the plant from the local low-pressure pipeline or stranded well, with only 17% of the natural gas used as fuel for the prime mover. That combination of relatively low capital cost and low fuel use (high-efficiency) will yield an operating cost and "price per liter/gallon" that will allow the LNG to be sold at a discount to the market price of diesel, accounting for the energy content (BTU) both fuels.

That achievement—competitively priced LNG—will allow natural gas to be more than just an "alternative fuel" but also an economically viable alternative fuel.

The appended claims all relate to small-scale LNG production, however, all known literature on the topic, including reports by government funded entities and quasi-public agencies, are silent with respect to the disclosed method and system, known as the VX Cycle. Methane expansion cycles have not been looked at for small-scale LNG production because all of the existing methane expansion cycle LNG plants are associated with larger letdown plants. Thus, those that search for solutions to the small-scale LNG production model have concentrated on variations of mixed refrigerant and $N_2$ expansion cycles, thinking that such equipment might be reduced in size and kept cost-effective.

The disclosed invention utilized a different approach. The inventors of the current method and system recognized that mixed refrigerant and $N_2$ expansion cycles become uneconomical at small scales. Instead the inventors sought to take the benefits of letdown plants (which operate with virtually no fuel use because of the compressed gas that is delivered to them), and sought a small-scale version that would pay a modest penalty in energy costs but would still be cost effective because methane would be both the product stream and the refrigerant stream.

The lack of any known discussion in the prior art, regarding small-scale methane expansion cycles, indicates that the disclosed invention is non-obvious.

The attached process flow diagram illustrates the invention, which is known as the disclosed system. The invention is a unique and innovative variant of the methane expansion cycle, which to date, has only been deployed commercially in certain special, large-scale configurations, specifically known as "letdown plants". Thus, the system described here is also known as Vandor's Expansion Cycle or the "VX Cycle". Such letdown plants are relatively rare because of two required conditions—a high-pressure pipeline with a gate station (letdown valve) feeding a low-pressure pipeline system that serves a large network of gas customers. Such letdown plants take advantage of the compression of the natural gas "down-stream" from the plant, where that down-stream compressor serves as the energy input source for the high-pressure pipeline, and take advantage of the large low-pressure "sink" that is on the other side of the gate station. Letdown plants require that approximately 90% of the high-pressure gas to be letdowns be consumed by low-pressure gas customers beyond the plant in order to produce enough refrigeration to yield approximately 10% of the plant's inlet flow as LNG. For that reason (and because of the relatively large scale required for the economic operation of such plants), they are limited to urban locations where they are used for the production of LNG during off-peak periods for release as vaporized gas during peak demand periods.

Thus stand-alone, methane expansion cycles (letdown plants) are not common and are limited to relatively large "peakshaving" plants. By contrast, the VX cycle is a non-obvious and substantial improvement of the known letdown process. The VX cycle eliminates the need for a high-pressure pipeline because it includes a CNG compressor. That compressor will serve two distinct functions—at the front end of the cycle it will compress low-pressure pipeline gas (or low-pressure gas from a stranded well) to moderate pressure, and re-compress the recycle stream that is the product of the multi-step letdown process at the back end of the cycle. That innovation will not only allow the VX cycle to use methane expansion as an LNG production technique on low-pressure pipelines without an off-site "sink" for the letdown stream, but it will also allow methane expansion to be used at stranded wells where there are no opportunities for disposing of any portion of a letdown stream.

Unlike existing letdown plants, the VX cycle offers a significant, novel, and non-obvious method of using methane expansion as a liquefaction technique in a stand-alone LNG plant that can be placed at low-pressure pipelines, on stranded wells, at off-shore oil platforms where gas is now flared, on LNG ships where boil off is often vented, and in other such circumstances where the standard letdown plant cannot be deployed. Like the standard letdown plant, but unlike all other LNG cycles, the VX cycle will use natural gas as both the product stream (out of which LNG will be produced) and the working fluid (refrigerant) that produces the deep refrigeration required for liquefaction. Particularly at small scales of production, by eliminating mixed refrigerant streams, multiple cascades, and the expansion of such non-methane working fluids as N2, the VX cycle will offer a relatively simple way of producing LNG. That simplicity directly stems from the novel use of methane as both the product steam and working fluid, and the use of an ordinary CNG compressor to do both of the compression functions described above. All the rest of the design for the VX plant represent rational optimizations related to clean up of the inlet gas, re-use of the waste heat from the prime mover for pre-cooling purposes, and known heat exchanger and sub-cooler systems. Other optimizations will likely be identified as each VX plant is engineered. However, those amendments will build on the VX Cycle, a non-obvious variant of the methane expansion cycle that can start with low-pressure feed gas (on- or off-pipeline), and which does not need to dispose of 90% of the inflow stream to off-site "sinks".

The disclosed method and system assumes that a low-pressure natural gas pipeline or stranded well is available adjacent to the fleet that will use the liquefied natural gas; that the natural gas is delivered at a pressure of 60 psia or greater; at a temperature of approximately 60° F.; and with a chemical composition that is about 95% methane, with some $N_2$ and $CO_2$, but otherwise "clean". If the inlet pressure is lower than 60 psia, the VX cycle will still function quite well, but with a slightly lower efficiency because of the extra compression required. In the event that the pipeline gas is not as clean, there are several known clean up systems that can be integrated with the disclosed method and system.

The low-pressure (60 psia) pipeline stream is separated into a fuel stream that provides fuel to a natural gas fired "prime mover", such as an internal combustion engine, and into a product stream to be compressed and liquefied. The use of natural gas as a fuel in a prime mover (an internal combustion engine or gas turbine) is well understood and is not claimed as an innovation.

The first step in the liquefaction process is the removal of $CO_2$ and any water from the pipeline gas stream, in a multiple vessel molecular sieve, which requires periodic regeneration, where the regeneration gas (loaded with $CO_2$) is sent to the prime mover (engine) for use as fuel. This step is well understood in the industry and is not claimed as an innovation. The cleaner the pipeline gas the less complex the molecular sieve system and the less frequent the need for regeneration.

The cleaned, dry natural gas is sent to a multi-stage natural gas compressor, such as used at CNG stations. A novel aspect of the disclosed method and system is the use of a CNG station and/or standard CNG equipment to produce liquefied natural gas.

The disclosed method and system will allow existing CNG stations to be upgraded to LNG production, by using the existing CNG compressors; and it will allow makers of existing CNG equipment to participate in the expansion of the vehicle-grade LNG industry. Thus, a widely deployed small-scale LNG network need not displace all existing, well established CNG production and dispensing facilities, allowing for a smooth transition from low-density CNG to high-density LNG, including the continued dispensing of CNG, say, to light-duty vehicles.

The feed gas to the LNG plant will be compressed, in stages, from, about 60 psia to about 400 psia. That choice is an essential feature of the invention because pressures to 3,500 psia are routinely provided by most CNG compressors. Operating a CNG compressor at lower pressures will reduce the compressor's workload and reduce the "heat of compression" that is absorbed by the natural gas.

The disclosed system has a preferred compression range of about 375 psia to about 400 psia, yielding a unique balance between compressor work in the front end and refrigeration output at the back end of the cycle. That front-end compressor work includes the compression of a low-pressure recycle stream, whose pressure is directly related to the expansion of the 400-psia natural gas stream to approximately 18 psia during the refrigeration process.

The single CNG compressor will perform two functions. It will be both the feed gas compressor and the recycle compressor. This is possible because the disclosed method and system is an "all methane" cycle, where the working fluid (refrigerant) and the feed stream are both methane. Both streams will be compressed simultaneously in a single CNG compressor. This is a major advance in LNG production, because the only LNG plants that use methane cycles are letdown plants, generally found at pipeline gate stations that serve large urban areas. However, letdown plants (by definition) do not require compression because they rely on high-pressure feed gas, and have the opportunity to send out large quantities of low-pressure natural gas into local low-pressure pipelines.

The disclosed method and system will use a uniquely integrated absorption chiller to counteract the heat of compression and to pre-cool the CNG immediately after it exits the compressor's last stage after-cooler. That unique use of a well-established technology (absorption chilling) is a second innovation of the invention, and is described in more detail below.

Another novel aspect of the disclosed method and system is that the heat of compression will be mitigated, and the natural gas will be pre-cooled by refrigeration from an absorption chiller powered by waste heat from the prime mover.

The CNG compressor's inter-coolers (between stages) and after-cooler will be integrated with two distinct refrigeration sources. First the inter-cooler between the first and second stage of the multi-stage compressor will heat exchange the CNG stream with the colder recycle stream, chilling the CNG on its way to the second stage, and warming the recycle stream on its way to the first stage. This is an example of cold recovery from the low-pressure recycle stream that leaves the heat exchanger at approximately −30° F.

Second, the inter-cooler between the second and third stage will be cooled by the refrigeration output of the waste-heat driven absorption chiller, which can use aqueous-ammonia, or other fluids, such as propane as the working fluid. The same chiller will cool the CNG stream in the compressor's after-cooler, and in a subsequent heat exchanger, down to as cold as about −22° F.

The chiller will be "powered" by the waste heat from the prime mover, recovering a significant portion of the approximately 67% of the energy content of the fuel used by the engine that is normally "wasted" by the engine's exhaust and water jacket. That recovered heat will increase the about 32%-35% thermal efficiency of the engine to a practical efficiency of approximately 43%, through the refrigeration output from the absorption chiller.

The integration between the chiller and the compressor and between the cold recycle stream and the compressor will allow the "heat of compression" to be mitigated in each stage of the compressor, improving its efficiency and allowing the CNG to exit the compression cycle pre-cooled to about −22° F.

The pre-cooled CNG (at about 400 psia) will then be sent to a heat exchanger where it is further cooled, condensed, and (after several steps outside the heat exchanger) is sub-cooled and liquefied to produce liquefied natural gas, which will be sent to a cryogenic storage tank at an appropriate pressure (about 65 psia) and a temperature of approximately −245° F.

The absorption chiller will improve the cycle efficiencies in two ways. First, it will cool the compressors second-stage inlet stream. Second, it will reduce the "warm end loss" of the heat exchanger, turning it into "warm end gain".

The cooling of the compressor inlet stream will result in approximately a 10% reduction in compressor power usage. This feature alone will increase the efficiency of the prime mover from, about 33% to about 36.5%, or approximately 10 kW.

The chilling of the compressed feed gas will significantly reduce the stream's heat content (enthalpy), compared to the heat content of the returning low-pressure stream. That will happen because the feed gas will be compressed to nearly about 400 psia, where its behavior is "non-ideal" (similar to a liquid's behavior), while the low-pressure recycle stream (at about 18 psia) will behave in a nearly "ideal" manner. Those conditions will reduce the expander's refrigeration requirement by approximately 15%, reducing power demand by another 15 kW.

The total power reduction achieved (10 kW+15 kW=25 kW) equals about 20%. At the scale of the disclosed method and system, that power reduction is important.

Another novel aspect of the disclosed method and system is that the three main components of the "front-end"—the engine, the chiller, and the CNG compressor—will be linked, each to the other two components, allowing standard CNG equipment to produce cold, moderate pressure CNG. Those linkages are substantial departures from standard letdown plant designs, which do not include prime movers, absorption chillers or CNG compressors. Because standard letdown plants take advantage of very special conditions at pipeline gate stations, they do not need engines, chillers and compressors. For those reasons the VX cycle is not an obvious variant of letdown, but rather an innovative extension of methane expansion cycles to sites and conditions previously unsuitable for LNG production by methane expansion.

The disclosed method and system, unique among LNG cycles, will harness the CNG compressor's power source for the chilling of the CNG. The same engine that powers the CNG compressor will (through waste heat) power the chiller.

That integration is unprecedented for a variety of reasons, including because all other commercial-scale LNG cycles are not dependent on the compression of low-pressure gas to CNG, and the subsequent condensing and liquefaction by expansion of the same (cooled) CNG.

The disclosed system exploits the limitations of low-pressure methane compression-to-expansion, without using refrigerants such as $N_2$, as in nitrogen expansion cycles; or "mixed refrigerants" as in MR cycles; or hydrocarbons, as in cascade cycles; and without the inefficiencies of high-pressure Joule Thompson cycles. The disclosed method and system will achieve a good degree of the efficiency available to turbo-expander (letdown) LNG plants, but at much smaller scales and at lower capital costs, and without the need for a high-pressure pipeline or a low-pressure outflow "sink".

A significant portion of the product stream cannot be liquefied in a single run through the process and is sent back to the beginning of the cycle to be re-compressed, mixed with more (cleaned) natural gas from the pipeline (or stranded well), pre-cooled by the absorption chiller and sent through the heat exchanger for liquefaction. This return stream (the recycle stream) gives up its cold in the heat exchanger (a form of cold recovery), contributing to the cooling and condensing of the portion of the stream that ends up as LNG.

Another novel aspect of the disclosed method and system is that known refrigeration "producers", such as Joule Thompson valves and turbo-expanders are integrated at the "back-end" to convert the cold CNG produced in the front into LNG.

In order to achieve about −250° F. LNG at about 65 psia, significantly more refrigeration is needed than can be provided by the front-end chiller. Two sources of refrigeration are at work near the main heat exchanger.

The first refrigeration source is a Joule Thompson (JT) valve, also known as a throttle valve. The pre-cooled CNG at about 400 psia and about −22° F. is sent through the single heat exchanger where it is cooled to about −170° F. by the other streams within the exchanger. That combination of approximately 400 psia and about −170° F. allows for the use of a "plate fin" heat exchanger (rather than a more-expensive coil wound unit) and yields a worthwhile amount of JT refrigeration as described in the next paragraph. Thus, this novel aspect includes, in part, the selection of the about 400 psia and the about −170° F. temperature of the main stream, allowing a commonly available plate fin heat exchanger to "coordinate" and integrate the several refrigeration steps.

A portion of the about −170° F. stream, at about 400 psia, is sent through the JT valve, which (by pressure letdown) yields approximately −254 F. vapor and liquid at a pressure of only about 19 psia. That cold vapor+liquid stream is used to sub-cool the portion of the stream that is still at about −170° F. and about 400 psia, cooling it to about −251° F. and still at about 400 psia. The sub-cooled product is dropped in pressure to about 65 psia; forming LNG at about −250° F., which can be sent to the storage tank, without any "flash" (vapor) formation. This is an important point because if flashing were allowed, the vapor stream would need to be returned (after cold recovery) to the CNG compressor.

For the sake of clarity, the sub-cooler 94 is shown in the process flow diagram as a separate heat exchanger. However, the sub-cooling task might occur in the single plate fin heat exchanger.

The low-pressure stream that cooled the main product stream in the sub-cooler will be sent back toward the beginning of the process as part of the recycle stream. Prior to its return trip through the single heat exchanger, the recycle stream will be joined by a recycle stream from the second refrigeration source, a two-stage cryogenic methane turbo-expander 110. The combined recycle stream, while low pressure, will be cold enough to substantially cool the main process stream to about −170° F. The balanced use of a cold, low pressure recycle stream to achieve fairly deep refrigeration of the "moderate" pressure main stream is yet another novel aspect of the disclosed method and system.

The second source of refrigeration, the two-stage turbo expander 110, is needed because the JT effect alone is not efficient enough. The cryogenic methane expander will convert cold CNG to colder, lower-pressure natural gas by doing "work". The work can be recovered in an integrated compressor. If recovered, the "work" output of the expander (several kilowatts) can be applied toward the re-compression of the recycle stream, further reducing the workload of the CNG compressor and the need to fuel the prime mover.

The methane expander receives that portion of the main stream from the heat exchanger that did not travel toward the JT valve.

That second stream will leave the heat exchanger at approximately −90° F. to −104° F., and approximately 400 psia and will be expanded in the cryogenic expander to approximately 40 psia, and thus cooled to approximately −220° F.; sent back to the heat exchanger for "reheat" (cooling the other streams in the heat exchanger); exiting the heat exchanger at about 39 psia and about −30° F.; giving up its "coldness" to the warm outflow stream from the compressor that "loads" the expander; entering that compressor at approximately 35° F. and 38 psia; and returning to the second stage of the main compressor for further compression.

Both the JT valve and the expander function well with the about 400-psia inlet pressures. A higher pressure might yield slightly more refrigeration at the JT valve, but not enough to warrant a more expensive heat exchanger and the need for more work by the compressor. The about 400 psia is a "comfortable" inlet pressure for a small expander. In short the selected conditions constitute a "sweet spot" in the efficient small-scale production of LNG yielding an excellent balance between refrigeration produced, the size and temperature of the recycle stream, the workload of the compressor, and the total amount of LNG produced per unit of fuel required to run the compressor.

The JT effect, the sub-cooler and the expander reheat cycle outlined above are all known in the industry. What is unique is the application of those individual techniques to a small-scale LNG plant in a specific, optimal manner. The disclosed method and system uses the main CNG stream as a "working fluid" (refrigerant) to liquefy a significant portion of itself, returning a "recycle" portion for re-compression, but only after several "cold recovery" steps.

The pre-cooling by absorption refrigeration captures the waste heat of the engine and delivers a significant amount of refrigeration to the CNG compressor without any additional fuel use. The CNG compressor will be well within its capacities in its effort to compress a recycle and feed-gas stream to about 400 psia. The JT valve and sub-cooler will produce the LNG relatively efficiently because the product stream sent to the JT valve will be cold enough (about −170° F.) to yield LNG by sub-cooling. That cold stream to the JT valve will be available because the expander will produce about −220° F. natural gas. The addition of "compressor loading" to the expander will further reduce the workload on the CNG compressor and the fuel required by the prime mover.

The recycle stream will be lower in volume than found in alternative LNG cycles because of the combined effect of the front-end absorption chiller; the moderate pressure, cold JT valve; the sub-cooler; and the methane expander. The smaller recycle stream, will allow the compressor to do less work, requiring less power output from the prime mover, which in turn will use less fuel, reducing the plant's fuel use relative to the total output of LNG to levels matched only by much larger LNG plants.

Figure 2:
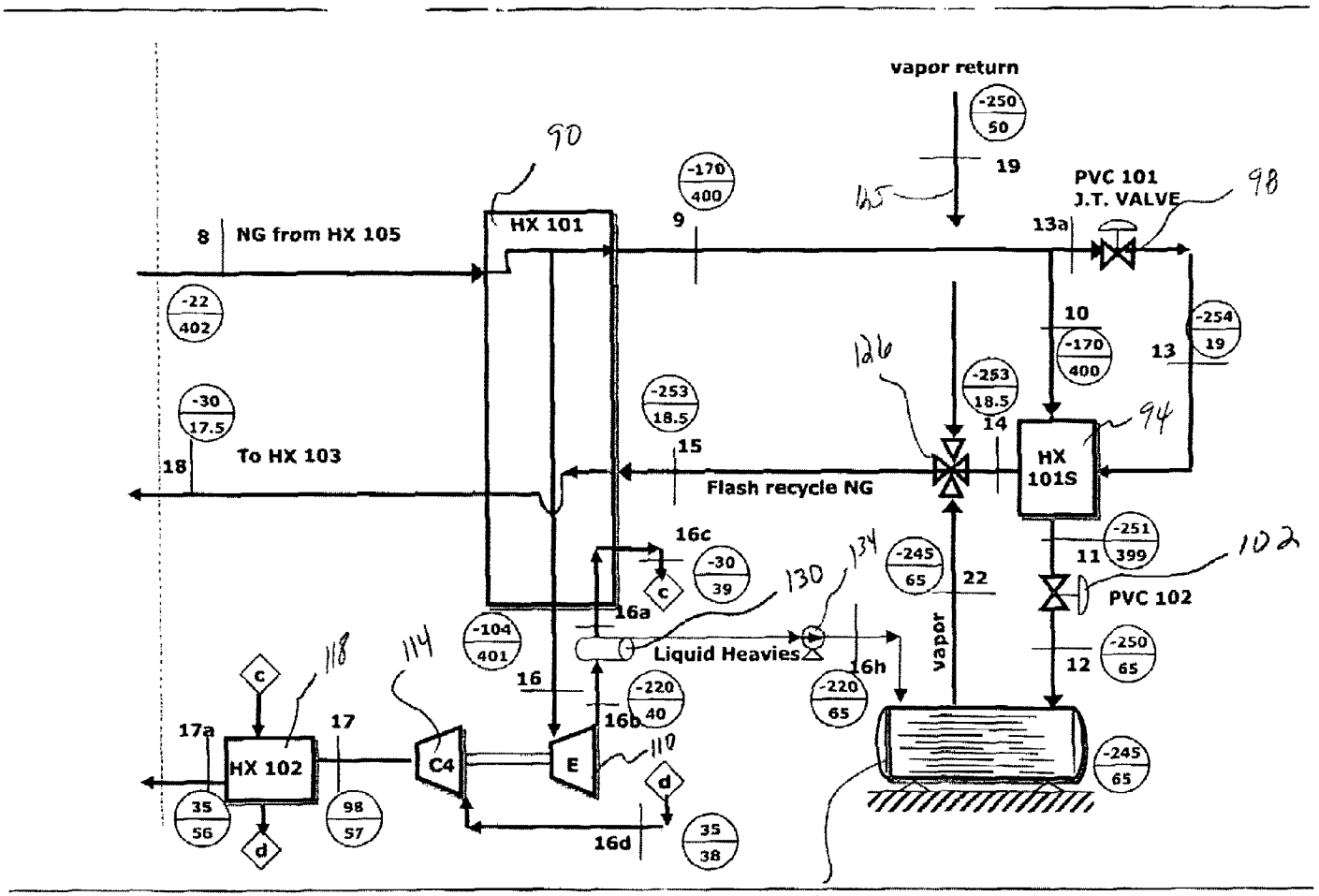
FIG. 2 is the remainder of the process diagram of the disclosed system.

FIGS. 1 and 2 shows a schematic diagram of one embodiment of the system for a small-scale production of LNG from low-pressure pipeline gas. The right side of FIG. 1 connects to the left side of FIG. 2. The approximate temperatures and pressures at various points are shown in circles, with the temperature on top, and the pressure at the bottom. Low-pressure (about 60 psia or greater) is the feed gas that will be used, in small part as the fuel for the prime mover 10, and will in large part be liquefied. A first inlet valve 14 near point la is the inlet connection from an adjacent natural gas pipeline (or from another natural gas source, such as a stranded gas well). A second inlet valve 18 is also an inlet connection from an adjacent natural gas pipeline (or from another natural gas source, such as a stranded gas well). This allows for a portion of the pipeline-delivered natural gas to be directed to the engine 10 during times such as: during start up of the plant, or to the clean up and liquefaction cycle beyond point 1*a*.

The prime mover 10 may be an internal combustion engine fueled by natural gas. A micro-turbine may also be used as the prime mover 10. The prime mover 10 directly drives a multi-stage compressor 34 comprising a first stage 22, second stage 26, and third stage 30. Variations on the number of stages are possible, as are methods for transferring the power of the prime mover to the compressor. Those variations will not impact the core methodology of the disclosed invention and may be selected on the basis of capital costs, equipment availability, and other "optimization" factors.

Waste heat from the prime mover 10 is used to heat the regeneration gas in the molecular sieve clean up system, discussed bellow. Waste heat is also used as an energy source in an ammonia absorption chiller 38, shown simply as a circle, which provides cooling to the compressor's second inter-cooler 82 and after-cooler 86, at the first heat exchanger 42 and second heat exchanger 46, which will be discussed in more detail below.

The waste heat from the prime mover 10 is delivered to the ammonia absorption chiller 38 by piping that extends the prime mover's jacket water system (not shown for clarity), which normally cools the engine. That hot jacket water is further heated by hot engine exhaust in the third heat exchanger 54. The engine exhaust gas is then sent to a flue 58 at about 225° F. A catalytic converter may be located at the appropriate place in the engine exhaust outflow system. A water pump 62 is shown just prior to the hot water's entry into the third heat exchanger 54. The pumping of the water with pump 62 to pressure will keep it from boiling. The hot water stream and the return stream from the ammonia absorption chiller 38 are shown as dotted lines on the process flow diagram.

The configuration of the ammonia absorption chiller 38, and its rejection of low-grade waste heat is a well-known technology. The process flow diagram does not show the internal process for the ammonia absorption chiller, but does show a cooling tower 66 which uses water as the cooling medium, disposing low-grade waste heat to the atmosphere. That cooling tower 66, in fluid communication with a make-up water line 67, also helps cool the compressor's inter- and after-coolers 80, 82, 86.

Point 3*a*' is the location where the inlet natural gas stream from the pipeline (or stranded well), at approximately 60 F and 55 psia, is mixed with a clean re-cycle stream (80 F, 55 psia) that arrives at that point from down-stream process points that will be described in subsequent sections of this narrative.

The first significant step in the liquefaction process is the clean up cycle, which is well understood by those in the natural gas processing field, especially related to natural gas that is delivered from a pipeline, known as "pipeline quality natural gas." Most pipeline gas contains some amount of $CO_2$ and water, which need to be removed prior to liquefaction; otherwise ice will form down stream in the process, causing the cycle to "freeze up".

A molecular sieve 70 is configured to remove $CO_2$ and water from the natural gas in an adsorbent such as, but not limited to, zeolyte. The molecular sieve 70 does not remove any heavy hydrocarbons from the natural gas feed stream. That portion of the clean up cycle, if required, occurs near point 16*a*, and will be discussed below. The molecular sieve 70 may be a multi-vessel system that regenerates the adsorbent beds by using heated natural gas as the "purging" fluid. The resultant $CO_2$ laden regeneration gas is sent from the molecular sieve 70 to the prime mover 10 as fuel.

The process flow diagram does not show the configuration of the molecular sieve 70 system, nor the detailed piping and valves that control the delivery of hot exhaust gas to warm the regeneration stream, because that technology is well understood and is not an innovation of this invention.

At point 3*a*, the feed gas stream (at about 68° F., 55 psia) consists of the cleaned "make up" stream from the pipeline (or stranded well) and the recycle stream that joined it at point 2*a*. The reason clean recycled gas is mixed with pipeline gas, prior to the molecular sieve 70, is to reduce the $CO_2$ and water load on the mole sieve, by "diluting" the stream's $CO_2$ and water content. The stream arriving at point 2*a* is the outflow of the first stage compressor 22. The purpose of the first stage compressor 22 and the source of the "flash recycle" stream that it compresses will be discussed below. The stream arrives at point 2*a* after going through a first inter-cooler 80

The first cooling step in the LNG production process occurs through the fourth heat exchanger 74. The fourth heat exchanger 74 allows the about −30° F. "flash recycle stream" to chill the cleaned gas to about 42° F., as shown at point 3*b*. The slightly cooled main gas stream is mixed with a recycle stream from a natural gas expander's 78 (located on FIG. 2) outflow from point 17*a*. That recycle stream is arriving at point 3*b* at about 35° F. The combined natural gas stream, at point 3, now consists of the make up stream from the pipeline, the flash recycle stream and expander 78 recycle stream. The temperature of the stream at point 3 will be about 37° F. Note that the pressure of the stream drops slightly as it moves through piping and heat exchangers.

The combined stream enters the second stage compressor 26 at about 54 psia for compression, and leaves the second stage compressor 26 at about 210 psia. The heat of compression warms the natural gas stream to about 284° F., as shown at point 4.

Natural gas at about 284° F. and about 210 psia will be called warm CNG. The warm CNG is sent to an inter-cooler 82 (which is cooled by water from the cooling tower 66) and then on to the first heat exchanger 42 where it is further cooled by the refrigerant stream from the ammonia absorption chiller 38. The cooling water inflow and outflow from the inter- and after-coolers are not shown, because that aspect of the process is well understood by those familiar with gas processing and the workings of gas compressors.

The natural gas stream exits the first heat exchanger 42 at about 35° F. and 209 psia, as shown at point 5. It then enters the third stage compressor 30 for additional (and final) compression, leaving the third stage compressor 30 at about 150° F. (due to the heat of compression) and approximately 404 psia. The warm CNG travels to the after-cooler 86, exiting it at about 80° F. and then on to the second heat exchanger 46 where it is further cooled by the refrigerant from the ammonia absorption chiller 38 to about −22° F. The entire purpose of the waste-heat driven ammonia absorption chiller 38 is to chill the natural gas stream during its trip through the second and third stages 26, 30 of the compressor 34, and to deliver the natural gas, pre-cooled to about −22° F., to the plant's main heat exchanger 90 (shown on FIG. 2).

The main heat exchanger 90 is the main heat exchanger for the disclosed system. The sub-cooling heat exchanger 94 may be integrated into heat exchanger 90 or may be a separate heat exchanging unit as shown. The pre-cooled CNG enters the heat exchanger 90, traveling from point 8 toward point 9. However, it is split into two streams, one going to point 9 and one to point 16. The stream that moves to point 9 arrives there at about −170° F. as LNG at moderate-pressure, having been chilled by the counter-flowing stream in the main heat exchanger 90.

The moderate-pressure LNG moves from point 9 toward point 13, but is split into two streams, one of which moves through the first expansion valve 98 (also known as a Joule Thompson Valve), with the other portion moving on toward point 10. The first expansion valve 98 causes the LNG to become a two-phase (mostly liquid and less than about 30% vapor) stream, arriving at point 13 at about −254° F., but "letdown" to at a substantially lower pressure of only 19 psia. This stream's function is to act as a refrigerant on the main stream that is chilled to become LNG. Refrigeration occurs in a sub-cooling heat exchanger 94 as the liquid portion of the stream vaporizes and transfers its "coldness" to the about −170° F. LNG counter-flowing through the sub-cooler. The vaporization of the refrigerant stream does not change its temperature during that phase shift from liquid to vapor, allowing the vaporized refrigerant stream to move on to points 14 and 15 at approximately −253° F., ready to impart further cooling in heat exchanger 90, as described below.

That cryogenic two-phase "refrigerant" stream, described above, is sent through sub-cooling heat exchanger 94 (a sub-cooler) where it cools the "product" stream arriving from point 10 (about −170° F., 400 psia) to become LNG, arriving at point 11 at about −199° F. to approximately −251° F. by the time the product reaches point 11. The about 399 psia LNG is then dropped in pressure through another expansion valve 102 arriving at point 12, and subsequently sent to the LNG storage tank 106, at the design pressure of that tank. In the embodiment shown in FIGS. 1 and 2, the tank pressure is about 65 psia. Other storage pressures will also work. The extent of "sub-cooling" of the stored product is related to pressure at which the product is stored in the LNG storage tank. In this context, sub-cooling may be defined as the extent to which the stored product is colder than the temperature at which it will boil, at its storage pressure. Lower storage pressures require colder LNG in order to prevent boil off and flash losses, due to heat gain. Thus, sub-cooling of the stored LNG is a strategy that limits (or substantially eliminates) vaporization of the stored LNG due to unavoidable heat gain to the insulated storage tank.

Returning to the "refrigerant" stream that exits the sub-cooling heat exchanger 94, it arrives at points 14 and at 15 at approximately −253° F. and moves on for additional "cold recovery" in heat exchanger 90, leaving the main heat exchanger 90 at approximately −30° F., as indicated by the values shown at point 18 and 18*a*. The remaining cold is further recovered in the fourth heat exchanger 74, as discussed above. The relatively warm stream (about 35° F.) arrives at point 18*b* at just about 17 psia. Thus, the function of the first stage compressor 22 is to recompress this (clean) stream so that it can return to the cycle and join the make up stream after point 2*a*, as discussed above.

Returning to the stream that entered heat exchanger 90, and was split into two portions, we can now follow the portion that arrives at point 16. Its trip through heat exchanger 90 allowed the about −22° F. inflow stream to be chilled by the other streams in the heat exchanger, so that it exits heat exchanger 90 at between about −90° F. to about −105° F. (the "warmer" the exit stream, the less energy was spent on cooling it.) This stream is also a "refrigeration" stream, providing the bulk of the refrigeration required to cool the product stream. The, say, about −100° F. CNG (at approximately 400 psia) is sent to a turbo-expander 110 that substantially cools the stream by expanding it to about 40 psia, and by having the turbo-expander 110 "compressor loaded" (by an expander driven compressor 114) so that "work" is performed. It is the expansion process, including the work performed, that achieves the dramatic cooling of the CNG.

The exit stream from the turbo-expander 110 will be approximately −220° F. and about 40 psia (see point 16*b*), allowing the natural gas stream to separate into heavy hydrocarbon liquids (such as ethane, and butane) and a nearly pure methane stream in a phase separator 130, shown near point 16*a*. That phase separation will take place if the feed gas contains any such heavy hydrocarbons. In that event, the liquid heavies are sent through a pump 134, to increase the stream's pressure (see point 16*h*), and then sent into the storage tank 106 to join the main liquid product of the process, the liquefied natural gas. The exact location of where the liquid heavies enter the tank can vary, and is subject to engineering decisions related to the mixing of the slightly warmer heavy hydrocarbon liquids with the larger and colder LNG, that will not impact the basic aspects of the disclosed system. Note that the small heavies stream, which is approximately at −220° F. will slightly warm the contents of the LNG tank, even though it is receiving LNG at approximately −250° F. On the other hand, if the feed gas to the cycle contains very little or no heavy hydrocarbons, such slight warming will not occur. For feed gas streams with a higher concentration of heavy hydrocarbons, or where the product LNG is used by vehicles that cannot tolerate any significant heavy hydrocarbon content in the LNG, some portion of the heavies from the phase separator may be sent as fuel to the prime mover. In short, the disclosed system can tolerate a variety of feed gas compositions, including from pipelines and stranded wells, and variety of product specifications for the LNG.

Continuing the process at 16*a*, the very pure methane stream, at −220 F. is a refrigerant stream that helps cool the stream that went from point 8 to 9 and the stream that went from point 8 to point 16. In this manner, (and by way of the sub-cooler previously described), the pre-cooled (about −22° F.) about 400 psia CNG is both a "product" stream (beyond points 10, 11, and 12) and a refrigerant stream. This aspect of the disclosed system, is a unique version of a "methane expansion" cycle and is a core element of the innovation.

The outflow stream from the turbo-expander 110 leaves the heat exchanger 90 at about −30° F. and serves to mitigate the heat of compression as the same (about 39 psia) stream is sent through the expander driven compressor 114 that "loads" the turbo-expander 110. That "cold recovery" occurs in a fifth heat exchanger 118, allowing the expander 110 recycle stream to enter the expander driven compressor 114 at a "warm" state of about 35° F., exiting the expander driven compressor 114 at about 98° F., and exiting the fifth heat exchanger 118 at about 35° F., having dealt with the heat of compression. One optimization of the disclosed system may include a water-cooled after-cooler immediately after the expander driven compressor 114, before point 17, allowing the temperature of the stream to be cooler than now shown at point 17*a*, all of which is included in the scope of the disclosed system. Other optimizations will be obvious to those familiar with natural gas processing, but without impacting the core aspects of the innovative methane expansion cycle disclosed here.

It is the work performed by the expander driven compressor 114 that allows the expander 110 recycle stream to be returned to point 3*b* at about 56 psia, so that it can enter the second stage compressor 26 at a moderate pressure, rather than the first stage compressor 22 at a lower pressure.

Figure 3:
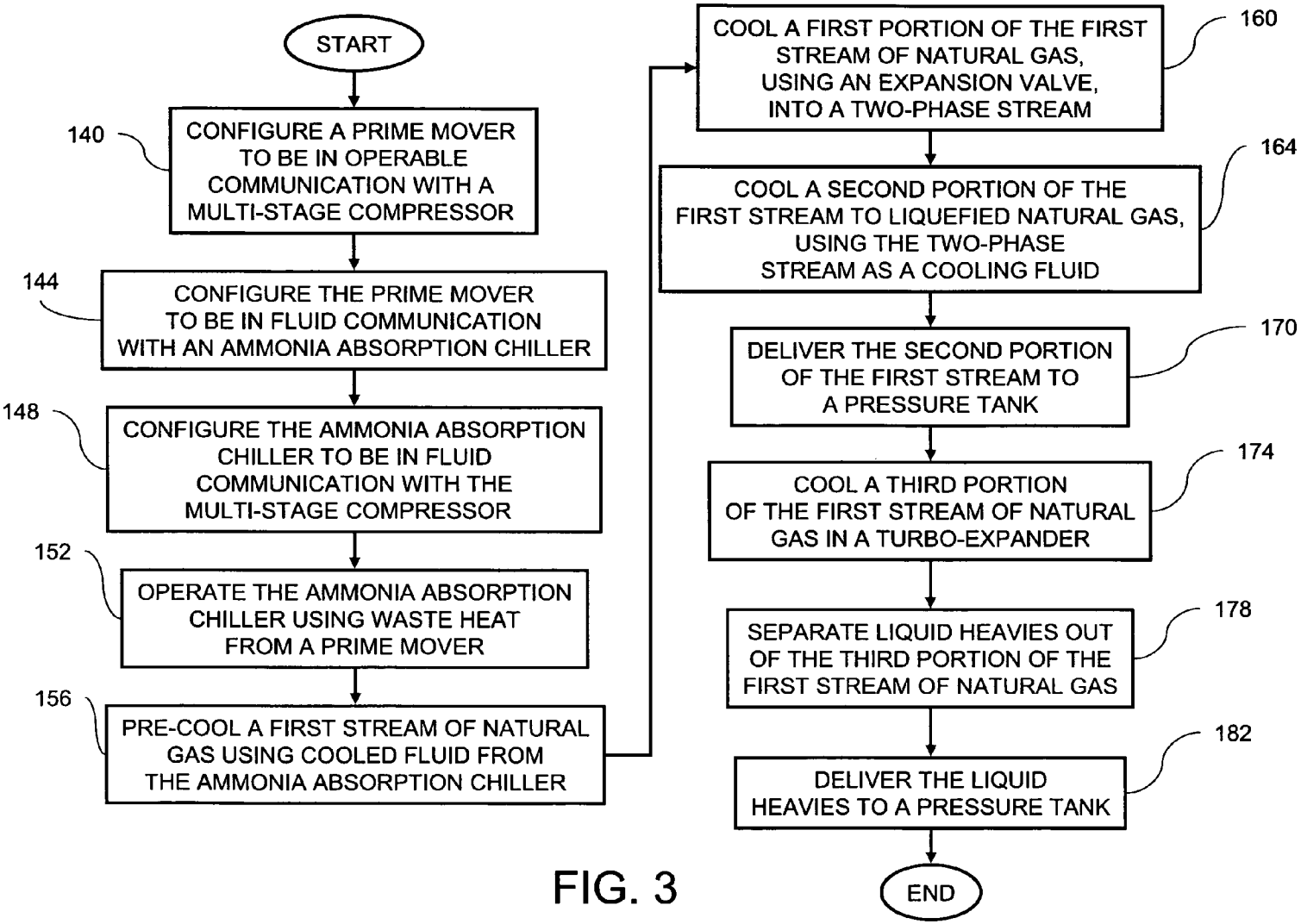
FIG. 3 is a flow chart illustrating one embodiment of the disclosed method.

FIG. 3 shows a flowchart showing a disclosed method of the invention. At act 140 one configures a prime mover to be in operable communication with a multi-stage compressor. At act 144 one configures the prime mover to be in fluid communication with an ammonia absorption chiller. At act 148 one configures the ammonia absorption chiller to be in fluid communication with the multi-stage compressor. At act 152 the disclosed system operates the ammonia absorption chiller using waste heat from a prime mover. At act 156 the system pre-cools a first stream of natural gas using cooled fluid from the ammonia absorption chiller. At act 160 the system cools a first portion of the first stream of natural gas, using an expansion valve, into a two-phase stream. At act 164 the system cools a second portion of the first stream to liquefied natural gas, using the two-phase stream as a cooling fluid. At act 168 the system delivers the second portion of the first stream to a pressure tank. At act 172 the system cools a third portion of the first stream of natural gas in a turbo-expander. At act 176 the system separates liquid heavies out of the third portion of the first stream of natural gas. At act 180 the system delivers the liquid heavies to a pressure tank.

The disclosed system has many advantages. The disclosed system starts with low-pressure pipeline-quality natural gas (or low-pressure stranded gas) and a prime mover 10 (such as, but not limited to an engine), which drives a multi-stage compressor. The waste heat of the prime mover is used to heat regeneration gas that "sweeps" one of several beds (sequentially) in a standard molecular sieve 70, removing $CO_2$ and water, and sending the regeneration gas back to the prime mover. The bulk of the waste heat provides heat to an ammonia absorption chiller 38 that produces a significant amount of refrigeration without any additional fuel use. The ammonia absorption chiller 38, which is integrated with a standard (water) cooling tower 66, helps remove the heat of compression in each stage of the compressor, and significantly pre-cools the CNG stream prior to its entry into the main heat exchanger 90. The pre-cooled, moderate pressure liquefied/CNG (at about 400 psia) is separated into two streams on two occasions, such that one stream becomes the "product" stream, and the other streams act as refrigerant streams. The refrigeration is provided by first and second expansion valves 98, 102 and by a compressor-loaded turbo-expander 110, resulting in cold, low-pressure recycle streams that need to return to the main compressor for compression to about 400 psia. Those recycle stream are used as refrigerants in the main heat exchanger 90 and in the sub-cooling heat exchanger 94, with further cold recovery along the return flow of the recycle streams. The disclosed system yields clean, cold, low-pressure, sub-cooled LNG, suitable for a variety of applications (including as a vehicle fuel). The disclosed system does not need complex cascade cycles that use multiple refrigerants and further does not need a separate refrigeration cycle (such as are needed in $N_2$ expansion systems, or mixed refrigerant systems). The disclosed system does not need to expand high-pressure gas into a low-pressure pipeline such as in standard "pressure letdown" cycles at "gate stations". The disclosed system results in a ratio of produced product (LNG) to fuel use that will be better than 80 to 20, and possibly in excess of 85 to 15, depending on further optimizations and the internal efficiencies of the main components.

It should be noted that all temperatures and pressures listed are approximate, and the disclosed system will work at other selected temperature and pressure values, but the 400 psia range of the CNG is a "sweet spot" for a methane expansion cycle. The heat recovery from the prime mover 10, and the use of the ammonia absorption chiller 38 is not an essential element of the innovation. For example, a high-efficiency gas-fired turbine (for example, with an adjacent steam cycle or an organic Rankine cycle) may increase the efficiency of the prime mover 10 (by using its waste heat) such that the operation of the ammonia absorption chiller 38 would not be viable. In that event, the disclosed system would "spend" more energy on compressing the CNG, but by way of a more efficient prime mover, thus causing the total energy use to be about the same. Similarly, the main compressor 34 may be, in an alternative embodiment of the disclosed system, an electric power driven compressor, especially where low-cost electricity is available. The vapor return stream shown on the process flow diagram is to allow any "flash" from the liquefied natural gas-fueled vehicle's storage tank to be recycled, rather than vented. The vapor return stream may travel within a vapor return line 125. The process flow diagram shown in FIGS. 1 and 2 is for an about 6,000-liter/day plant with a low-pressure pipeline, for such customers as LNG vehicles. However, the disclosed system is not limited to small-scale (pipeline based) plants. It is unique in its efficiency and relative simplicity and therefore suitable for small-scale, low-pressure pipeline sites. It will work as well (and more efficiently) on higher-pressure gas sources (pipelines, and wells) and at larger scales. The make up water line 122 on FIG. 1 would come from a standard "city water line". The 4-way valve 126 shown on FIG. 2 is merely a "diagram". In reality, those valves will not be in a single location, as shown. Some streams may enter other streams through "T" connections without valves. Thus the 4-way valve may comprise a single 4-way valve, or a plurality of valves.

The flow-rates of the various streams are not discussed above because that will vary for each plant, based on its size. For the 6,000-liter/day plant discussed here, the following are approximate gas flow rates (in pounds per hour) at typical points in the cycle. The flow rate of LNG (not including the heavies), at point 12 in the process flow diagram is approximately 207 lb/h; the make-up stream from the pipeline will contain 327 lb/h, of which approximately 60 lb/h are used as fuel by the prime mover; the flow rate at point 9 will be approximately 386 lb/h; the flash recycle stream at point 15 will be approximately 179 lb/h; the stream traveling to the expander toward point 16 will be approximately 1,450 lb/h; the recycle stream at point 17*a*, having given up its heavies content through point 16*h*, will pass through 17*a* at approximately 1,398 lb/h; while the recycle stream from the sub-cooler, through point 18 and 18*a* is 179 lb/h. Those flow rates can vary depending on factors such as the energy content of the feed gas; the amount of heavy hydrocarbons in the feed; the efficiency of the various components, especially the prime mover and the cryogenic expander; the desired temperature and pressure of the stored LNG; and the level of insulation of all the pipes and cryogenic components. Of course the above listed values can be adjusted, modified and tuned by system engineers, dependent on various factors, such as but not limited to desired output. The liquid heavies separator 130 (and the stream of liquid heavy hydrocarbons) may be in the plant, but may not need to function on those days when the make up stream is very low in heavies. However, if the stream is more laden with heavies, then some of those heavies could be sent to the engine for fuel, rather than to the LNG tank. The above description does not dwell on the type of heat exchangers used, because those choices are well understood by gas process engineers and are not relevant to the core innovations of the disclosed system. The disclosed system's relatively modest operating pressures will result in cost savings on all components, including heat exchangers, when compared to other cycles that operate at higher pressures. A discussion of the appropriate insulation of hot and cold lines, and the design of valves and sensors are not covered above because those technologies are well understood by process engineers.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A system for the small scale production of LNG comprising:

a natural gas supply, the natural gas has a pressure in a range of about 55 psia to about 350 psia;

a prime mover in fluid communication with the natural gas supply, and in fluid communication with a third heat exchanger;

a multi-stage compressor in operational communication with the prime mover; the multi-stage compressor comprising a first stage compressor, a second stage compressor, and a third stage compressor, and where the inlet temperature of fluid entering the first stage compressor is less than 40° F., and where the inlet temperature of fluid entering the second stage compressor is less than 40° f;

a first inter-cooler in fluid communication with the first stage compressor;

a molecular sieve in fluid communication with the first inter-cooler and in fluid communication with the natural gas supply;

a fourth heat exchanger in fluid communication with the molecular sieve and in fluid communication with the first stage compressor;

a second inter-cooler in fluid communication with the second stage compressor;

a first heat exchanger in fluid communication with the second inter-cooler and in fluid communication with the third stage compressor;

an after-cooler in fluid communication with the third stage compressor;

a second heat exchanger in fluid communication with the after-cooler;

a main heat exchanger in fluid communication with the second heat exchanger, in fluid communication with a phase separator, in fluid communication with a gas turbo-expander, and in fluid communication with the fourth heat exchanger, where an operational flow rate of the main heat exchanger to the gas turbo-expander being as low as about 1450 lb/hr during continuous operation;

a first expansion valve in fluid communication with the main heat exchanger;

a sub-cooling heat exchanger in fluid communication with the first expansion valve;

a second expansion valve in fluid communication with the sub-cooling heat exchanger;

a pressure tank in fluid communication with the second expansion valve;

a four-way valve in fluid communication with the pressure tank;

the four-way valve in fluid communication with the sub-cooling heat exchanger and in fluid communication with the main heat exchanger;

the gas turbo-expander in fluid communication with the phase separator, and in operational communication with an expander driven compressor;

the expander driven compressor in fluid communication with a fifth heat exchanger;

the fifth heat exchanger in fluid communication with second stage compressor;

an ammonia absorption chiller in fluid communication with the prime mover, in fluid communication with the first heat exchanger, in fluid communication with the second heat exchanger, in fluid communication with the third heat exchanger, and in fluid communication with a cooling tower;

a make-up water line in fluid communication with the cooling tower; and wherein the amount of LNG produced by this system while continuously running during a 24 hour day being as low as about 6000 liters, and wherein the second expansion valve is configured to expand fluid from a pressure in the main heat exchanger to a storage pressure in the pressure tank.

2. The system of claim 1, wherein the first expansion valve is a joule Thompson valve.

3. The system of claim 1, wherein the second expansion valve is a joule Thompson valve.

4. The system of claim 1, further comprising:

a flue in fluid communication with the third heat exchanger.

5. The system of claim 1, further comprising:

a vapor return line in fluid communication with the four-way valve.

6. The system of claim 1, wherein the pressure tank is configured to hold natural gas at temperature of about −240° F. to about −250° F., and at a pressure of about 65 psia to about 100 psia.

7. The system of claim 1, wherein the pressure tank is configured to hold natural gas at about −245° F. and about 65 psia.

8. The system of claim 1, wherein the natural gas supply is a natural gas pipeline.

9. The system of claim 1, wherein the natural gas supply is a stranded well.

10. The system of claim 1, wherein the pressure of the fluid leaving the third stage compressor is about 375 psia to about 400 psia.

11. The system of claim 1, where the natural gas supply has a pressure of about 60 psia.

* * * * *